US005524749A

United States Patent [19]

Thompson et al.

[11] Patent Number: 5,524,749

[45] Date of Patent: Jun. 11, 1996

[54] SAFETY CARD CASE FOR MACHINE READABLE CARDS

[76] Inventors: Rosemary Thompson, 15 Bayview Ave. East, Lindenhurst, N.Y. 11757; Adele Sutton, 6058 56th St., Maspeth, N.Y. 11378

[21] Appl. No.: 348,332

[22] Filed: Dec. 2, 1994

[51] Int. Cl.[6] ..... A45C 15/00

[52] U.S. Cl. ..... 206/38; 206/449; 206/38.1; 150/147

[58] Field of Search ..... 206/37.1, 37.8, 206/38, 38.1, 39.3, 449; 224/252, 253; 70/456 R; 150/147

[56] References Cited

U.S. PATENT DOCUMENTS

| | | | |
|---|---|---|---|
| 1,262,005 | 4/1918 | Bell . | |
| 1,465,281 | 8/1923 | Morrison | 224/253 |
| 1,567,783 | 12/1925 | Best . | |
| 1,716,689 | 6/1929 | Freemark . | |
| 2,071,757 | 2/1937 | Matthews | 206/38.1 |
| 3,547,323 | 12/1970 | Sledge, Jr. . | |
| 3,968,670 | 7/1976 | Quenot . | |
| 4,422,316 | 12/1983 | Thomas et al. . | |
| 4,502,226 | 3/1985 | Hung . | |
| 4,714,184 | 12/1987 | Young et al. . | |
| 4,927,354 | 5/1990 | Sanford . | |
| 5,026,274 | 6/1991 | Jacob . | |
| 5,038,926 | 8/1991 | van der Toorn | 206/39.3 |
| 5,125,505 | 6/1992 | Kurosaki | 206/38 |
| 5,358,158 | 10/1994 | Darr . | |

FOREIGN PATENT DOCUMENTS

| | | | |
|---|---|---|---|
| 8701915 | 4/1987 | WIPO | 206/38 |

*Primary Examiner*—David T. Fidei
*Attorney, Agent, or Firm*—Kenneth P. Robinson

[57] ABSTRACT

A safety card case is provided for retention of machine readable cards before, during and after use. Machine readable cards, such as credit, bank or casino comp cards, are fastened to the end of a flexible tether. The other end of the tether is attached to the spring-loaded reel assembly of an extension/retraction device mounted within the back portion of the card case enclosure. The machine readable cards are then safely retained for convenient storage or use by extension and retraction of the tether with the cards remaining attached.

7 Claims, 3 Drawing Sheets

SAFETY CARD CASE FOR MACHINE READABLE CARDS

This invention relates to protection of machine readable cards from loss before, during and after use and, more particularly, to safety card cases providing retention of such cards by provision of a safety case including an extendable/retractable flexible tether.

BACKGROUND OF THE INVENTION

As plastic machine readable cards come into increasing use as credit cards, bank cards and casino comp cards for use at gambling casinos to qualify for customer benefits, lost cards are becoming an increasing problem. At gambling casinos, for example, "comp" cards are issued to casino patrons. During gaming activities, such as slot machine play, the card is inserted into a slot in order to permit recording of qualifying credits during the slot machine activity. Such credits are then automatically accumulated by casino computer storage.

Lost and misplaced cards are a problem for both casinos and patrons. When a comp card is lost or left in a machine, the patron must locate and stand on an oftentimes extensive line at a card-issuing location in order to obtain a new card. In addition to the time and cost required for new card issuance, the casino is subject to decreased gaming activities while patrons stand on line and patrons waste portions of their excursion or vacation time. For credit cards and bank cards, the problems associated with lost cards and cards left in automatic teller machines (ATMs), etc., are well known and of much more potential significance than for casino comp cards.

In the past, devices have been provided for retention of items such as keys. Such devices have typically included a retractable cord or chain connected to a spring-activated spool or reel carried on the user's belt. However, when in a retracted position such devices generally allow the keys to simply dangle loosely in an unprotected manner. Dangling metal keys are both strong enough, to resist damage or breakage and small and compact enough to not be subject to twisting or becoming caught in clothing, doors, machinery, etc. Thus, key rings and other previously available devices have not been suitable for use with, or adequate to solve the special problems associated with, use and retention of machine readable cards.

Objects of the present invention are, therefore, to provide new and improved safety card cases for machine readable cards which provide one or more of the following:

- card retention during use and during storage;
- attachment of machine readable cards to a flexible tether which is selectively extendable and retractable; and
- card storage in and extension from a card holder which is belt-mounted or otherwise supported in a fixed position on a user.

Additional objects are to provide safety card cases which enable machine readable cards to be used and retained while avoiding loss or misplacement of such cards.

SUMMARY OF THE INVENTION

In accordance with the invention, a safety card case for machine readable cards provides card retention during both card extension for use and card retraction for storage. An enclosure configured to removably store at least one machine readable card bearing machine readable data includes an openable access flap having a closure device. Enclosure support attachment means is attached to the enclosure for supporting the enclosure in a fixed position on a user. Extension/retraction means are mounted within the enclosure and include a spring-loaded reel assembly.

The safety card case also includes a flexible tether connected at one end to the extension/retraction means, extending through an opening in the enclosure, and arranged to be selectively extended from the enclosure and retracted in a position wound around the reel assembly. Card attachment means is fixed to the other end of the flexible tether and configured for attachment of at least one machine readable card to the flexible tether in a manner enabling machine reading of each card without detachment from the safety card case. The safety card case is thus arranged to provide physical retention of each machine readable card while the card remains attached to the flexible tether, both during storage and during machine reading of data carried on the card.

For a better understanding of the invention, together with other and further objects, reference is made to the accompanying drawings and the scope of the invention will be pointed out in the accompanying claims.

DESCRIPTION OF THE INVENTION

Figure 1A:
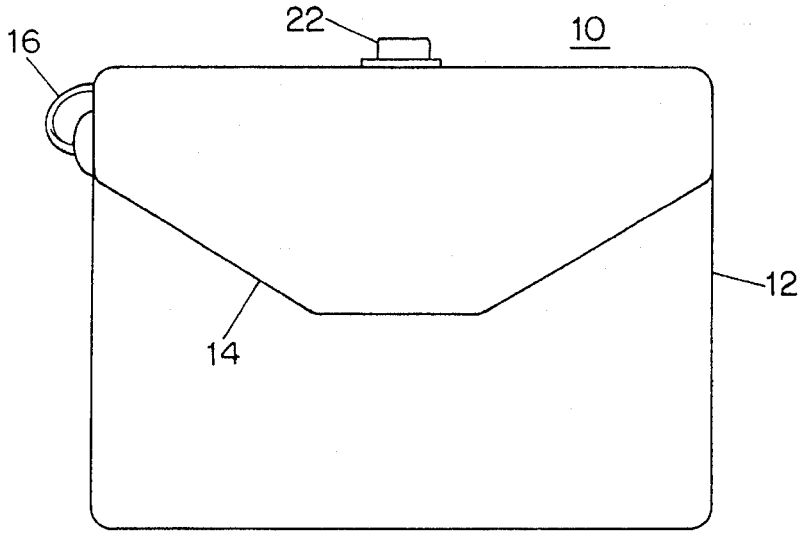
FIGS. 1A, 1B and 1C are respectively front, end and back views of an embodiment of a safety card case utilizing the invention.
Figure 1B:
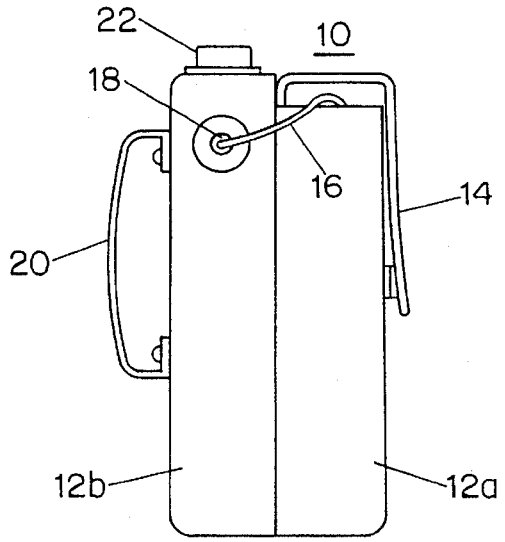
Figure 1C:
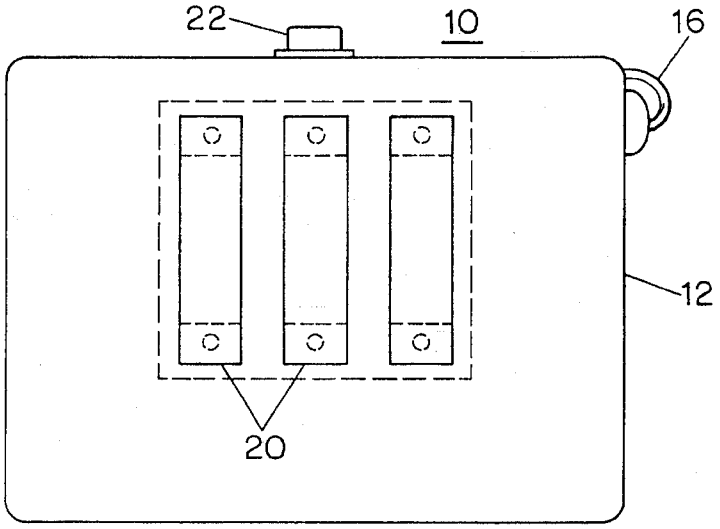

FIGS. 1A, 1B and 1C are front, end and back views of one embodiment of a safety card case 10 for machine readable cards in accordance with the invention. As shown in the front view of FIG. 1A, case 10 includes a card holder illustrated as enclosure 12 of generally rectangular shape and dimensioned for storage of machine readable cards of the type bearing a magnetic stripe for use in credit card, bank card and casino comp card applications, for example. Visible in the FIG. 1A view are a front flap 14 arranged to be selectively opened or closed and secured by a hook and loop or other type of closure. In FIG. 1A, a portion of a flexible tether 16, which may be a nylon line, a plastic line reinforced with a metal wire, a tape, or a chain, for example, is shown extending from the side of case 10 under the front flap 14. In the end view of FIG. 1B it can be observed that in this embodiment the enclosure 12 includes a front portion 12*a* and a back portion 12*b*.

Front portion 12*a* of enclosure 12 is configured to removably store at least one machine readable card bearing machine readable data and is accessed and secured by means of the openable access flap 14. As shown, back portion 12*b* includes an opening through which flexible tether 16 is extended and retracted by operation of an internally mounted extension/retraction device which will be described with reference to FIG. 3. FIG. 1B also shows in side profile support means, illustrated as metallic belt loop 20, for supporting enclosure 12 in a fixed position on a user, i.e., on the user's belt. Back view 1C shows the belt loop 20, which may include cut-outs as shown or be of a solid or other appropriate configuration of metal, plastic, etc. Also visible in FIGS. 1A, 1B and 1C is a retraction control device, shown as button 22, for releasably controlling retraction of the flexible tether 16 by the enclosed extension/retraction device 24 visible in the FIG. 3 cut-away view.

Figure 2:
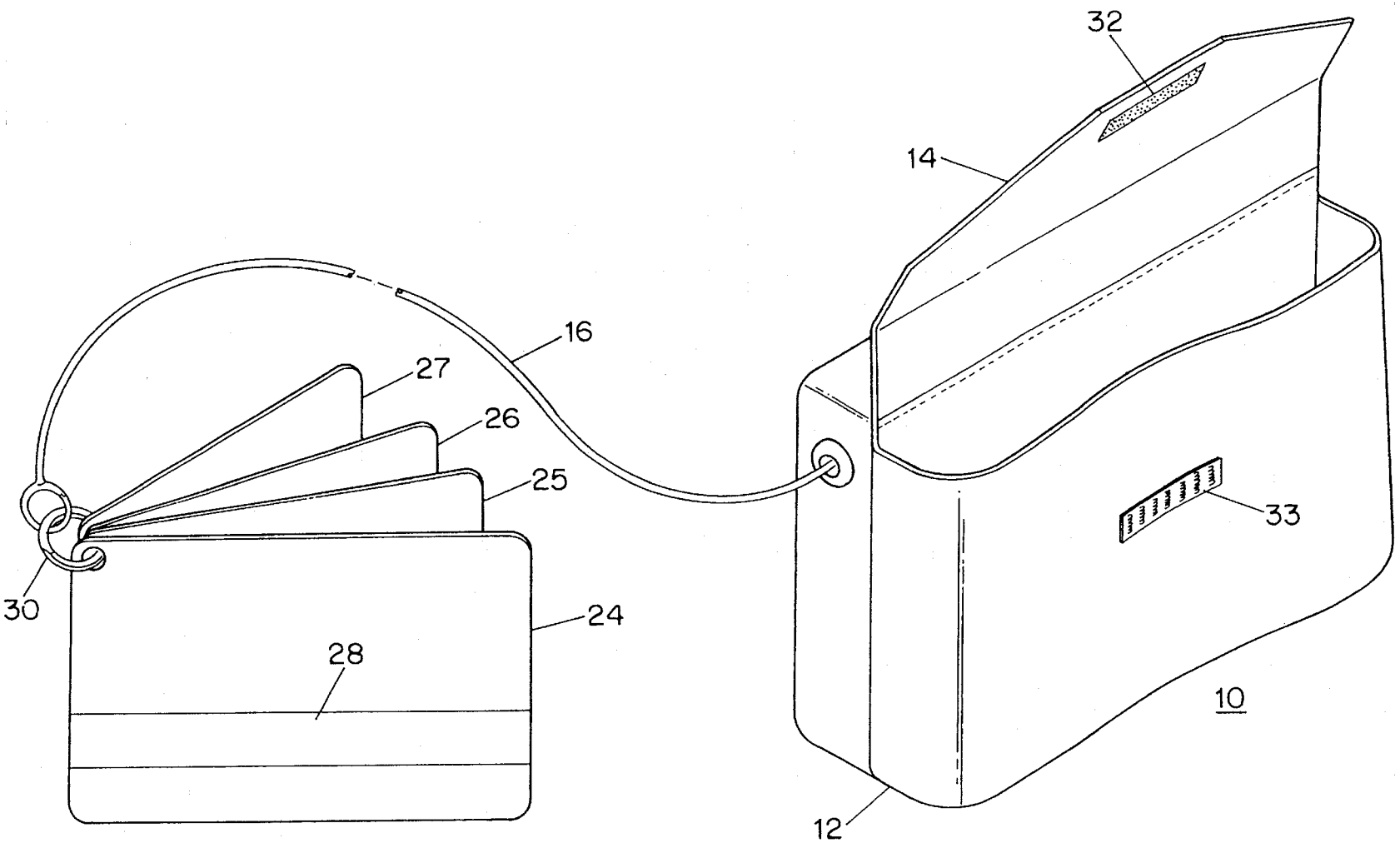
FIG. 2 is a perspective view of the safety card case with access flap opened and machine readable cards removed and extended for use.

Referring now to FIG. 2 there is shown a perspective view of safety card case 10 of FIGS. 1A, 1B and 1C with flap 14 opened and flexible tether 16 shown extended from the enclosure 12. As illustrated, four machine readable cards 24, 25, 26 and 27 are attached to one end of the flexible tether 16 by card attachment means 30, which may comprise a split ring device configured for insertion through a hole in each of cards 24–27. Card 24 is shown as typically including a magnetic stripe 28 enabling the card to carry machine readable data encoded into the magnetic stripe in well known manner. In the FIG. 3 view access flap 14 includes a closure device represented as hook and loop type portions 32 and 33. In other embodiments other closure devices, such as well-known types of snap or magnetic closures may be used.

Figure 3:
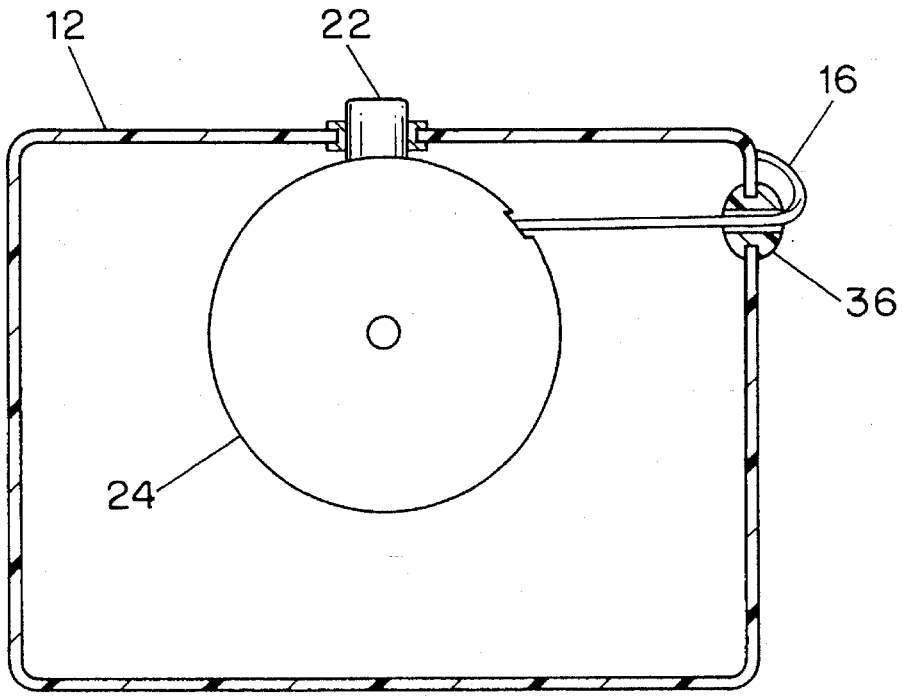
FIG. 3 is a back view of the safety card case with the back removed to show positioning of a spring-loaded extension/retraction device.

FIG. 3 is a cut-away rear view of enclosure 12 showing extension/retraction means 24 fixed to the enclosure within the back portion 12*b*. As illustrated, device 24 comprises a known type of spring-loaded reel assembly such as described, for example, in prior references such as U.S. Pat. Nos. 1,262,005, 1,567,783 and 4,502,226. Flexible tether 16 is connected at one end to the extension/retraction device 24, extends from the enclosure via an opening circumferentially covered by grommet 36, and is arranged to be selectively extended from the enclosure and retracted in a position wound around the reel assembly of device 24. In well known manner, the tether (whether it be in the form of a nylon or other line, tape or chain) is stored in position wound around the reel assembly and the spring-loading of the reel is arranged to permit the tether to be extended by being drawn off the reel assembly. The tether 16 is then enabled to be retracted by being re-wound around the reel assembly by action of stored spring tension. A retraction control device shown as button 22 may be provided, as described in the aforesaid U.S. Pat. No. 4,502,226 for example, to permit the tether to be retained in the extended position with releasable control of retraction by activation of control button 22.

Figure 4A:
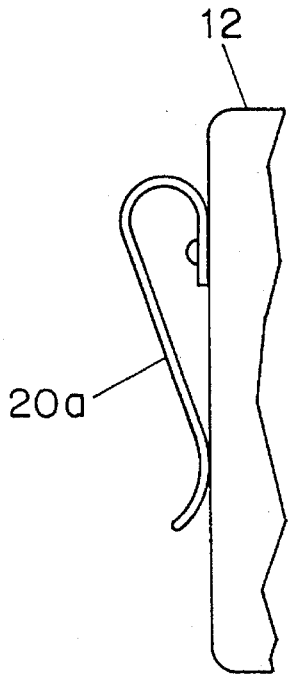
FIGS. 4A and 4B are end views of a portion of the safety card case showing alternative types of support devices.
Figure 4B:
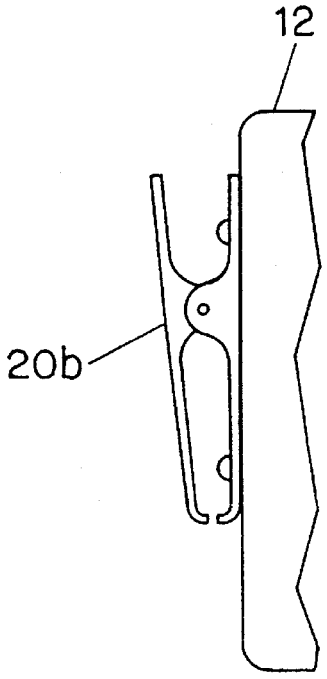

FIGS. 4A and 4B illustrate alternative forms of the support means shown as a belt loop 20 in FIG. 1B. FIG. 4A shows a belt clip type support 20*a* and FIG. 4B shows a clamp 20*b* of a common spring-loaded type configuration which may be provided to permit support from a belt or other portion of a user's clothing. In other embodiments the card holder may take the form of an open-ended card retaining clip or strapped configuration, or other arrangement, and the support means may take the form of a wrist strap with hook and loop type closure, or other arrangement.

In use of a safety card case in accordance with the invention, one or more machine readable cards, such as credit, bank and casino comp cards can be first attached to the end of the flexible tether 16 and stored inside the enclosure 12. Enclosure 12 can then be placed on the user's belt or otherwise conveniently positioned on the user by attachment to clothing, wrist, etc. For use of the cards they are withdrawn from enclosure 12 and tether 16 is extended from the enclosure. During use the cards are retained on the end of the tether, avoiding loss or misplacement of the cards. After use of the cards the spring-loaded extension/retraction device 24 is activated to retract the tether 16 to a position wound around the internal reel assembly of device 24. The cards 24–27 can then be returned for storage within the front portion 12*a* of enclosure 12 and retained in place by closing and securing access flap 14.

While there have been described the currently preferred embodiments of the invention, those skilled in the art will recognize that other and further modifications may be made without departing from the invention and it is intended to claim all modifications and variations as fall within the scope of the invention.

What is claimed is:

1. A safety card case for machine readable cards, providing card retention during both card extension for use and card retraction for storage, comprising:

an enclosure configured to removably store at least one machine readable card bearing machine readable data and including an openable access cover having a closure device;

enclosure support means attached to said enclosure for supporting said enclosure in a fixed position on a user;

extension/retraction means mounted within said enclosure and including a spring-loaded reel assembly;

a flexible tether connected at one end to said extension/retraction means, extending through an opening in said enclosure, and arranged to be selectively extended from said enclosure and retracted in a position wound around said reel assembly; and card attachment means connected to the other end of said flexible tether and configured for attachment of at least one machine readable card to said flexible tether in a manner enabling machine reading of each said card without detachment from said safety card case;

said safety card case arranged to provide physical retention of each said machine readable card while attached to said flexible tether, both during storage and during machine reading of said data carried on said card.

2. A safety card case as in claim 1, wherein said extension/retraction means includes a retraction control device for releasably controlling retraction of said flexible tether.

3. A safety card case as in claim 1, wherein said flexible tether is one of: a nylon line, a reinforced line, a flexible tape, a metal chain.

4. A safety card case as in claim 1, wherein said enclosure support means is attached to the back of said enclosure and is one of: a belt loop, a belt clip, a clamp.

5. A safety card case as in claim 1, wherein said enclosure is constructed of flexible plastic material and includes a hook and loop type closure.

6. A safety card case as in claim 1, wherein said card holder is dimensioned to store a plurality of one of: casino comp cards, credit cards, bank cards.

7. A safety card case as in claim 1, wherein said card attachment means is a split ring device configured for insertion through a hole in a machine readable card located at a separation from a magnetic stripe carried on said card.

* * * * *